US006631802B2

(12) United States Patent
Hsu

(10) Patent No.: US 6,631,802 B2
(45) Date of Patent: Oct. 14, 2003

(54) TOOL BOX DRILL BIT RETAINER

(76) Inventor: Cheng-Hui Hsu, No. 126, Pad Chung Road, Hsin Tien City, Taipei Hsien (TW)

( * ) Notice: Subject to any disclaimer, the term of this patent is extended or adjusted under 35 U.S.C. 154(b) by 82 days.

(21) Appl. No.: 09/975,979

(22) Filed: Oct. 15, 2001

(65) Prior Publication Data

US 2003/0070950 A1 Apr. 17, 2003

(51) Int. Cl.[7] ..... B65D 73/00
(52) U.S. Cl. ..... 206/373; 206/379
(58) Field of Search ..... 206/372, 373, 206/376, 377, 379, 477, 483, 486

(56) References Cited

U.S. PATENT DOCUMENTS 3,878,939 A * 4/1975 Wilcox ..... 206/373
5,855,274 A * 1/1999 Piao ..... 206/373

* cited by examiner

*Primary Examiner*—Jacob K. Ackun
(74) *Attorney, Agent, or Firm*—Rosenberg, Klein & Lee

(57) ABSTRACT

A tool box drill bit retainer that provides for the containment of different diameter drill bits inside the tool box, the primary application of which is keeping larger size drill bits within the drill bit recess of the tool box. The improved structure of the drill bit retainer effectively enhances the orderly securing of drill bits in the tool box and increases product practicality.

1 Claim, 5 Drawing Sheets

TOOL BOX DRILL BIT RETAINER

BACKGROUND OF THE INVENTION

1) Field of the Invention

The invention herein relates to a tool box drill bit retainer that provides for the containment of different diameter drill bits inside the tool box, the primary application of which is keeping larger size drill bits within the drill bit recess of the tool box. The improved structure of the drill bit retainer effectively enhances the orderly securing of drill bits in the tool box and increases product practicality.

2) Description of the Prior Art

In a conventional tool box drill bit holder, referring to FIG. 1, FIG. 2, and FIG. 3, the said conventional tool box 10 has disposed within a plurality of clips that hold a series of different diameter drill bits; larger size drill bits are grouped into a drill bit recess 11 of the conventional tool box 10 and a drill bit retainer 20 is fitted into an insertion hole 12 in the tool box 10 to keep the larger drill bits forcefully contained within the drill bit recess 11, wherein the conventional drill bit retainer 20 consists of a fan-shaped push plate 21 extending laterally from its upper edge and a locating column 22 projecting downward vertically, with the said locating column 22 having a flat face 23 formed along one side; the insertion hole 12 of the said tool box 10 is compatible in internal shape with the outer profile of the locating column 22 and has flat face along one side; the conventional tool box 10, as structurally described above, is capable of keeping larger size drill bits in position, but since tool boxes are frequently carried and moved about, the drill bit retainer 20 loosens in the tool box 10 insertion hole 12, causing the larger size drill bits to become scattered among the other drill bits inside the tool box 10, resulting in wear and damage from collisions.

In view of the said shortcomings in the structural technology of the conventional product that await improvement, the inventor of the invention herein, based on experience gained from engagement in the related industries and actual design experience, devised an original solution that culminated in the successful development of the improved tool box drill bit retainer of the invention herein.

SUMMARY OF THE INVENTION

The objective of the invention herein is to provide a tool box drill bit retainer that effectively stabilizes the containment of drill bits in the tool box and increases product practicality.

To enable a further understanding by the examination committee of the advantages, objective, and function of the invention herein as well as how the said objective is achieved, the brief description of the drawings below is followed by the detailed description of the most preferred embodiment.

DETAILED DESCRIPTION OF THE INVENTION

Figure 1:
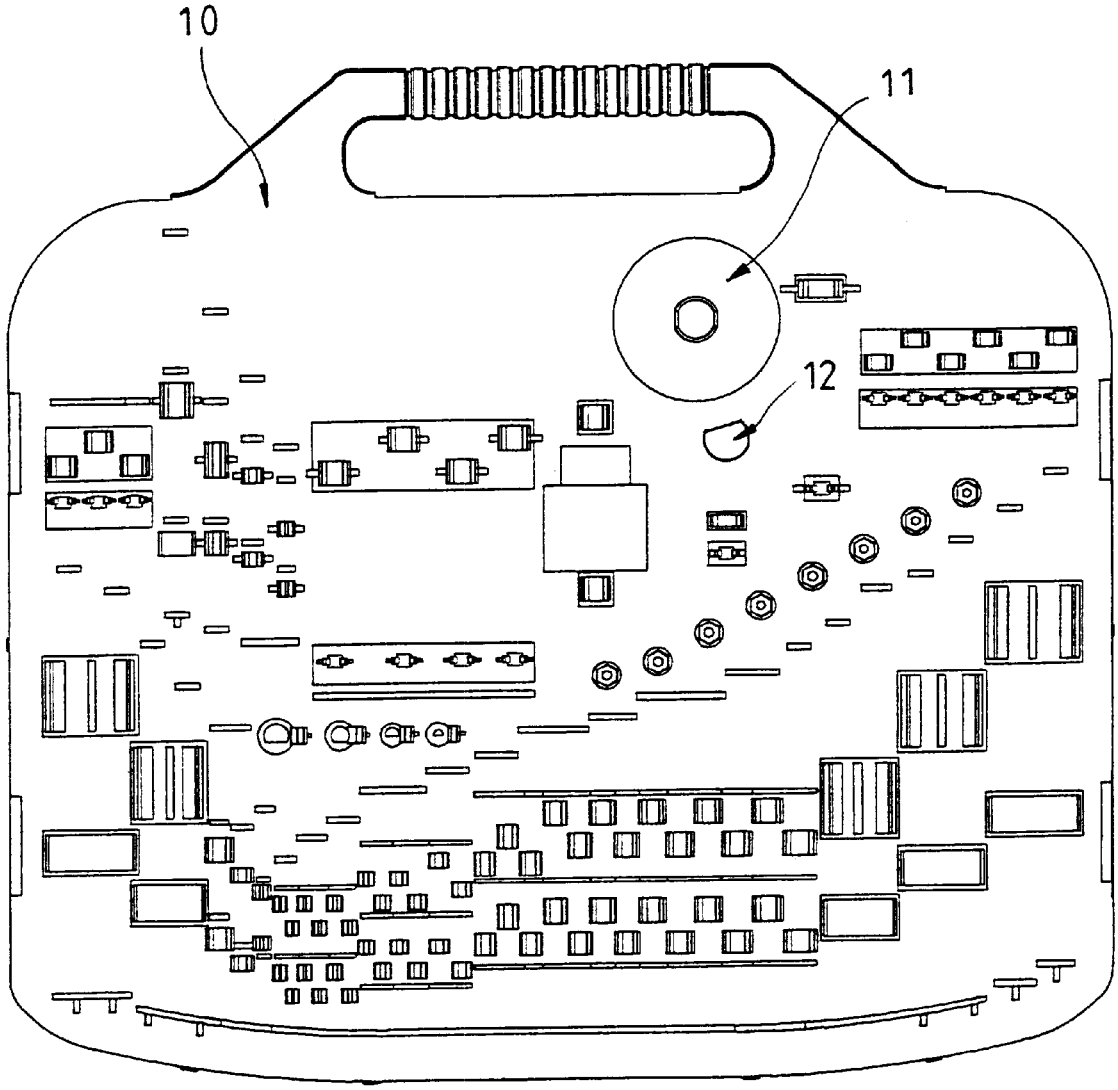
FIG. 1 (PRIOR ART)
FIG. 1 is an orthographic drawing of a conventional tool box 10.
Figure 2:
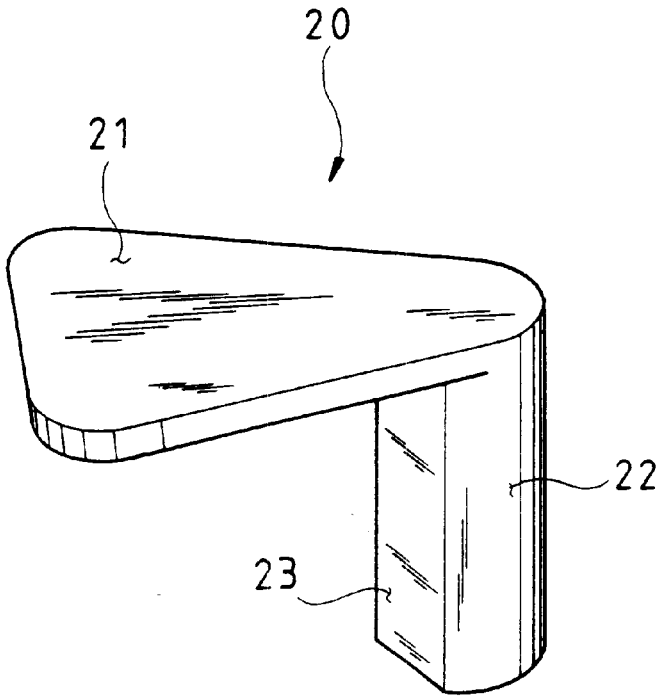
FIG. 2 (PRIOR ART)
FIG. 2 is an isometric drawing of the drill bit retainer 20 of a conventional product.
Figure 3:
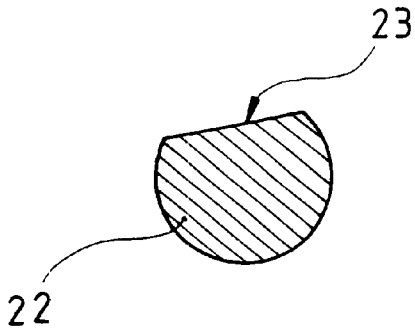
FIG. 3 (PRIOR ART)
FIG. 3 is a cross-sectional drawing of the locating column 22 of the conventional drill bit holder 20.
Figure 4:
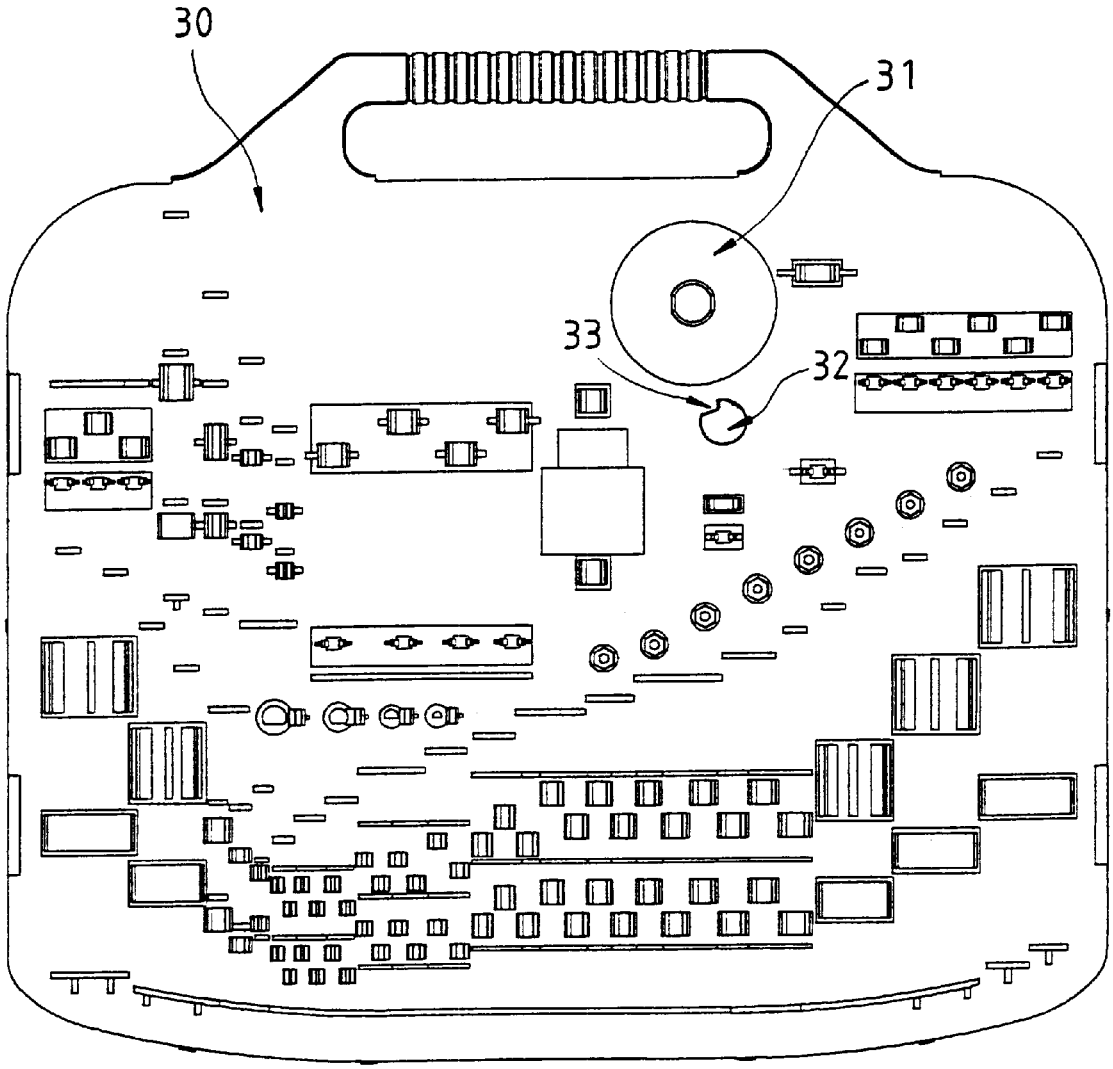
FIG. 4 is an orthographic drawing of the tool box 30 of the invention herein.
Figure 5:
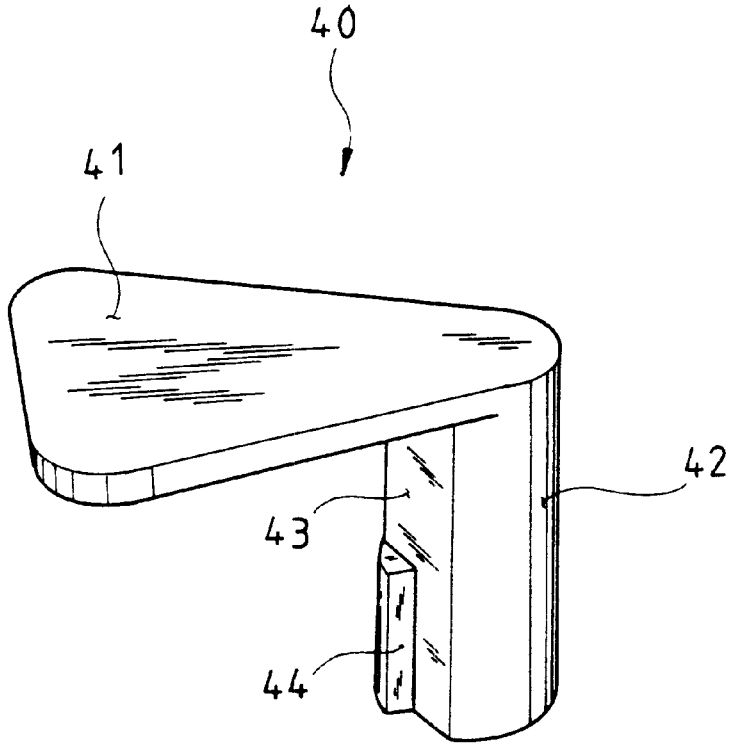
FIG. 5 is an isometric drawing of the drill bit retainer 40 of the invention herein.
Figure 6:
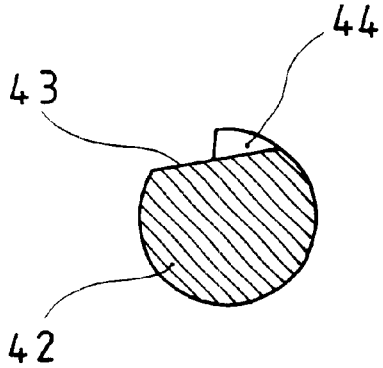
FIG. 6 is a cross-sectional drawing the locating column 42 of the drill bit retainer of the invention herein.
Figure 7:
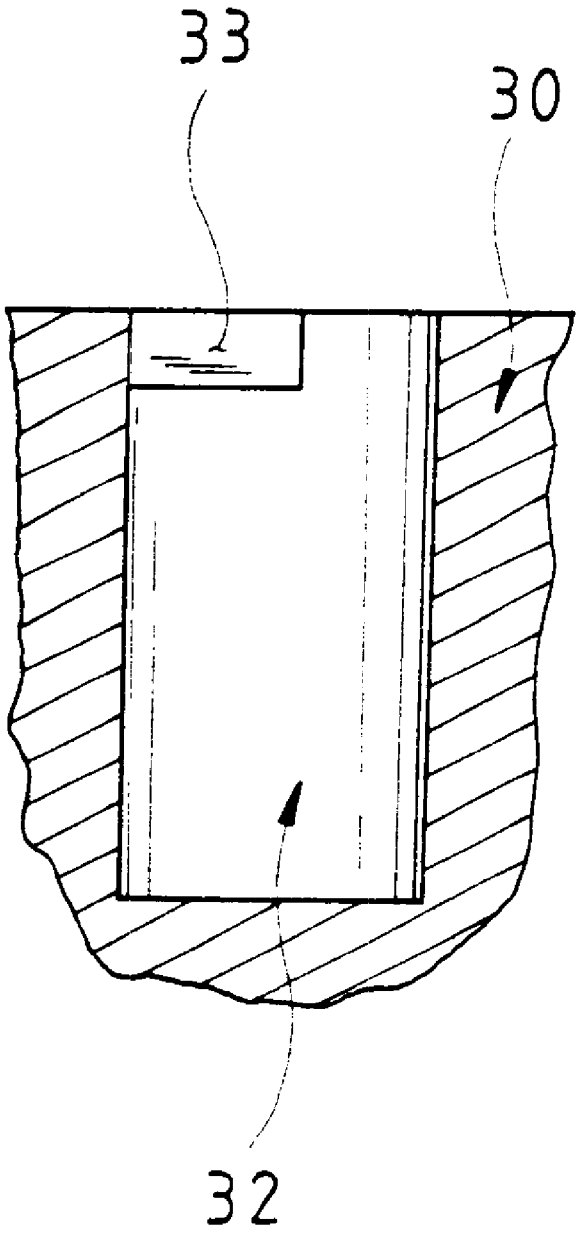
FIG. 7 is a cross-sectional drawing of the insertion hole 32 of the invention herein.

The invention herein is a tool box drill bit retainer; referring to FIG. 4, FIG. 5, FIG. 6, and FIG. 7, the said tool box 30 has arrayed within a plurality of clips that hold a series of different diameter drill bits; larger size drill bits are grouped into a drill bit recess 31 of the tool box 30 and a drill bit retainer 40 is fitted into an insertion hole 32 in the tool box 10 to keep the larger drill bits forcefully contained within the drill bit recess 31, wherein the said drill bit retainer 40 consists of a fan-shaped push plate 41 extending laterally from its upper edge and a locating column 42 projecting downward vertically, with the said locating column 42 having a flat face 43 formed along one side and, furthermore, a catch block 44 protrudes laterally along the lower half of the flat face 43; in addition, the internal shape of the insertion hole 32 in the said tool box 30 is compatible with the exterior profile of the locating column 42 and a stop block 33 having a thickness of approximately 2mm protrudes laterally from the top edge of the said insertion hole 32.

The invention herein is utilized to secure larger size drill bits that are grouped into the tool box 30 drill bit recess 31 and the drill bit retainer 40 is fitted into the tool box 10 insertion hole 32; with the centers of the drill bit retainer 40 and the insertion hole 32 in axial alignment, the catch block 44 on the locating column 42 of the drill bit retainer 40 is rotated in the tool box 30 until it engages the stop block 33 situated at the top edge of the insertion hole 32 which effectively secures the push plate 41 of the drill bit retainer 40 against the larger size drill bits. To obtain a larger sized drill bit from the tool box 30, the drill bit retainer 40 is rotated in the tool box 30 to disengage the catch block 44 from the stop block 33 at the top edge of the insertion hole 32, thereby enabling the removal of the drill bit retainer 40 and access to the larger drill bits.

In summation of the foregoing section, since the invention herein is capable of achieving the claimed utilization objective and the disclosed structure provides for greater practical value and, furthermore, no identical or similar product has been observed on the market, the present invention is submitted to the examination committee for review and the granting of the commensurate patent rights.

What is claimed is:

1. A tool box having a drill bit retainer, comprising:

a tool box having an upper side, said upper side having (a) a drill bit recess formed therein for receiving drill bits of predetermined sizes, and (b) an insertion hole disposed adjacent said drill bit recess, said insertion hole having a stop block extending from an inner wall thereof adjacent an upper end of said insertion hole;

a plurality of clips secured to said upper side of said tool box for retaining a plurality of drill bits of varying sizes; and, a drill bit retainer releasably coupled to said tool box, said drill bit retainer having a longitudinally extended loca tion column, a push plate extending laterally from a one end of said location column, and a catch block formed adjacent an opposing end of said location column, said location column being rotatably received in said insertion hole, wherein said drill bit retainer is rotated within said insertion hole until said catch block is engaged by said stop block to thereby direct said push plate into retaining engagement with drill bits in said drill bit recess, and is reversibly rotated to disengage said catch block from said stop block and withdrawn from said insertion hole to provide access to the drill bits in said drill bit recess.

* * * * *